US006447145B1

(12) United States Patent
Thomas et al.

(10) Patent No.: US 6,447,145 B1
(45) Date of Patent: Sep. 10, 2002

(54) GLASS ACCENT TRIM PLATE

(75) Inventors: Eric P. Thomas, Little Compton, RI (US); Daniel F. Francis, Warren, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/608,181

(22) Filed: Jun. 30, 2000

(51) Int. Cl.[7] ..... F21V 29/00

(52) U.S. Cl. ..... 362/267; 362/364; 362/105; 362/363

(58) Field of Search ..... 362/267, 363, 362/351, 105, 186, 365, 364, 368, 369; 220/802, 803, 804, 806, 792, 795

(56) References Cited

U.S. PATENT DOCUMENTS 3,675,007 A * 7/1972 Appleton et al. ..... 362/267
5,291,381 A 3/1994 Price
5,967,363 A * 10/1999 Allen ..... 220/806
6,250,776 B1 * 6/2001 Burkitt et al. ..... 362/267
6,723,588 * 8/2001 Arakelian ..... 362/267
6,364,152 B1 * 4/2002 Poslinski et al. ..... 220/788
6,371,630 B1 * 4/2002 Unger ..... 362/365

* cited by examiner

*Primary Examiner*—Sandra O'Shea
*Assistant Examiner*—Anabel Ton
(74) *Attorney, Agent, or Firm*—Jeffrey A. Haeberlin; Middleton & Reutlinger

(57) ABSTRACT

A luminiferous trim plate for a recessed lighting fixture includes a frustoconical cup, or similar shape, with an open bottom with a laterally extending primary flange. Sealing material is disposed on an upper surface of the primary flange. A lip extends upwardly around an outer periphery of the primary flange thereby preventing outward lateral movement of the sealing material when the plate is installed in the lighting fixture. The cup is formed of a non-conductive material so as to allow use in a moisture rich environment.

25 Claims, 1 Drawing Sheet

GLASS ACCENT TRIM PLATE

BACKGROUND OF THE INVENTION

1. Field of the Invention

The invention generally relates to lighting fixtures, and more particularly to trim plates for recessed lighting fixtures.

2. Description of the Related Art

Most trim plates for recessed lighting fixtures are composed of metal, plastic or some other material that does not transmit light therethrough. Of those trim plates that do provide for the transmission of light therethrough, none are configured to provide a watertight seal. For example, U.S. Pat. No. 5,826,970 teaches a light transmissive trim plate for a recessed lighting fixture, but fails to provide for a water tight seal. Thus, there is a need for a luminiferous trim plate that provides an ornamental illumination around the perimeter of the opening of a recessed lighting fixture and that also provides a watertight seal for use in areas where moisture may adversely affect the lighting fixture. Currently, the ornamental illuminations produced by luminiferous trim plates are limited to locations where moisture contact with the electrical components of a lighting fixture is unlikely. Current designs for luminiferous trim plates preclude their use around pools, fountains, hot tubs, showers and saunas, as well as in outdoor settings near bodies of water, such as on shorelines and boats. Thus, there is a need for a lighting fixture that combines the ornamental advantages of a luminiferous trim plate with the functional advantages of a water tight seal.

SUMMARY OF THE INVENTION

It is an object of the present invention to provide a trim plate for transmitting light through a body of the trim plate and its peripheral flange to the surrounding perimeter of the recessed lighting fixture in which it is housed.

It is another object of the present invention to provide an ornamental illumination around the perimeter of a recessed lighting fixture.

It is yet another object of the present invention to provide a trim plate that may be used to form a watertight seal around the opening of a recessed lighting fixture in which it is housed.

It is a further object of the present invention to provide a trim plate for a recessed lighting fixture that is constructed of non-conductive materials that provide a means for forming a seal around the lighting fixture.

It is still a further object of the present invention to provide a unitary trim plate for a recessed lighting fixture that allows for the replacement of the lamp of a recessed lighting fixture from below.

More particularly, the present invention provides a luminiferous trim plate comprising a cup open at one end and including a flange projecting laterally from the open end. The cup may be parabolic, hemispherical, cubical, conical or any another similar shape. Preferably, the cup will include a frustum with any one of the aforementioned shapes. The cup and flange will be formed from a glass, plastic or any other material that transmit light. The frustum of the cup may be formed of a material that differs from that which forms the rest of the cup and flange. For instance, the frustum may be formed of a transparent glass, while the remainder of the cup and flange is formed of a frosted glass. The flange will be so configured so as to provide a watertight seal between the opening of the recessed light fixture in which the trim plate is housed and its surroundings. A gasket or similar sealing means may be attached to the flange to facilitate the formation of the water tight seal.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1:
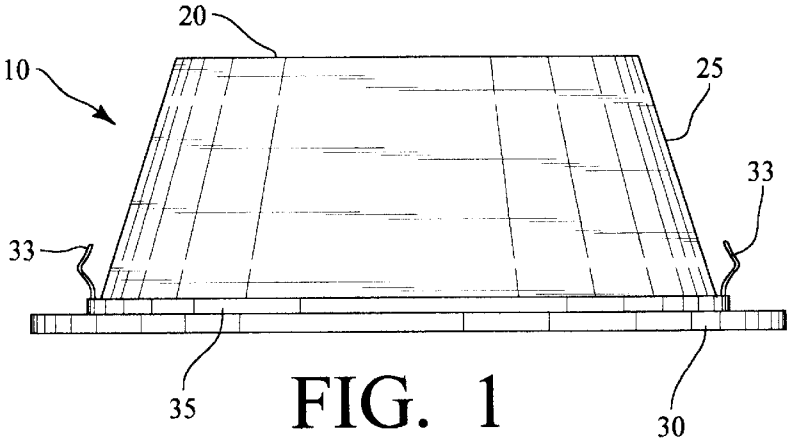
FIG. 1 is a side view of a trim plate of the present invention.
Figure 4:
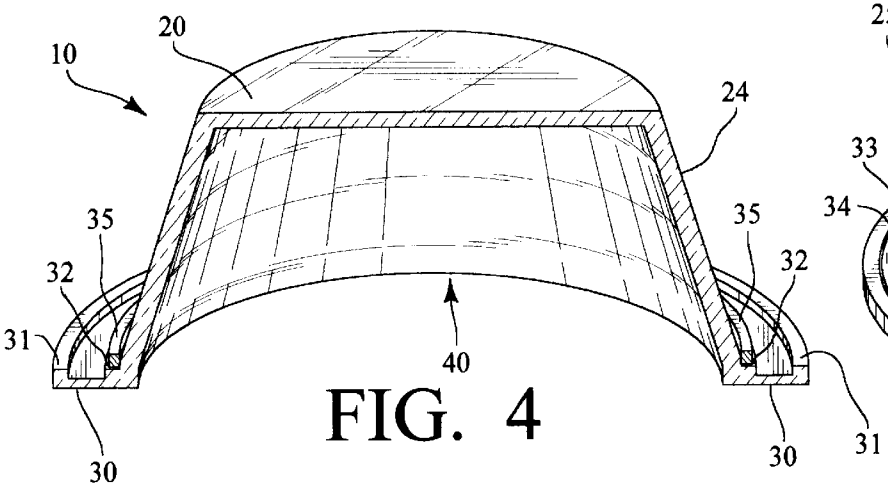
FIG. 4 is a perspective view of the trim plate of FIG. 1 with selected portions cut away.

As shown in the figures, a trim plate 10 of the present invention is provided with a frusto-conical cup 25 including a frustum 20. Cup 25 includes opening 40 in one end, and opposed closed top 20 and a sidewall 24. FIG. 1 shows the side view of the trim plate 10 of the present invention with a primary flange 30 and an annular mounting ring 35 which is attached to cup 25. Primary flange 30 has an outer diameter greater than that of a secondary flange 32, shown in FIG. 2. The primary flange 30 defines an opening 40, as shown in FIG. 4. Top 20 is integrally connected to sidewall 24 of cup 25. The cup 25, top 20 and primary flange 30 are formed of a transparent or translucent non-conductive glass, plastic or similar material and are preferably unitary in design. Mounting ring 35 may also be formed of these materials or from metal. However, the outer surface of sidewall 24 and the top surface of flange 30 and secondary flange 32 may be covered with an opaque coating, such as paint, clay, porcelain, or plastic, so as to allow light to travel through the body of the trim plate 10 while shielding the inner portion of the lighting fixture from view.

Figure 2:
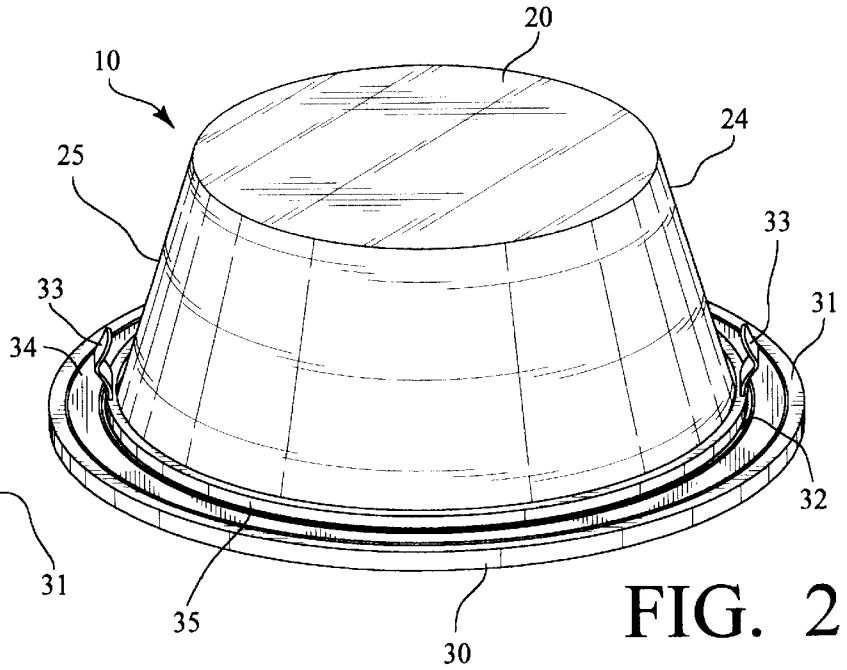
FIG. 2 is a perspective view of the trim plate of FIG. 1.

In FIG. 2, lip 31 projects upward from the outer periphery of primary flange 30. FIG. 2 also shows top 20 integrally formed to the sidewall 24 of trim plate 10. Top 20 may be formed of transparent glass or plastic, or it may be formed of a translucent glass, plastic or other non-conductive material. FIG. 2 also shows secondary flange 32 encircling the perimeter of the base of sidewall 24. As shown in FIG. 4, secondary flange 32 may be the same height as lip 31. Attached to mounting ring 35 is one or more locking members 33 for the securing of trim plate 10 to a recessed lighting fixture, not shown.

A gasket 34 is also provided as shown in FIG. 2. Gasket 34 rests upon or is disposed on a top surface of primary flange 30 between lip 31 and secondary flange 32. Gasket 34 may be made of foam rubber, plastic, or any other polymer known in the art and used to form a seal. When trim plate 10 is installed in a recessed lighting fixture, gasket 34 is sandwiched between primary flange 30, lip 31, secondary flange 32 and the ceiling or wall, not shown, in which the recessed lighting fixture is installed. Gasket 34 is thereby compressed longitudinally and tends to expand laterally so as to form a seal between trim plate 10 and the ceiling or wall.

Figure 3:
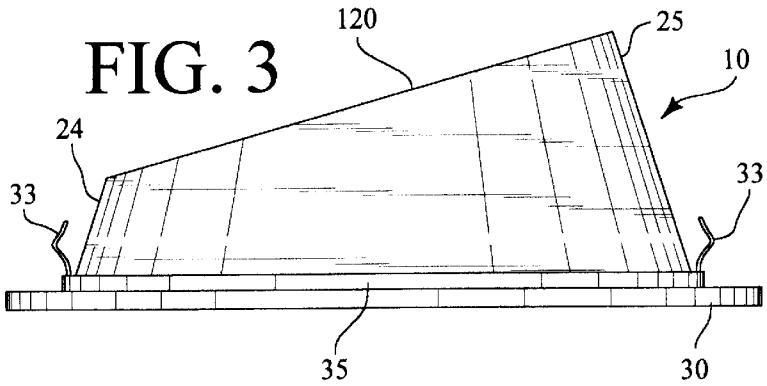
FIG. 3 is a side view of another embodiment of the trim plate of the present invention.

FIG. 3 shows another embodiment of the trim plate of the present invention. In this embodiment, top 120 is non-parallel to the base of sidewall 24 and flange 30, as in the embodiment shown in FIG. 1. Rather, top 120 is set at an incline relative to flange 30. Closed top 120 is also integrally formed to sidewall 24, as in the previous embodiment, and may also be formed of a transparent or translucent glass, plastic or similar non-conductive material. This embodiment of the trim plate 10 may be used within a recessed lighting fixture to direct the light produced within the fixture in a direction other than axially through the opening of cup 25. It is envisioned that the closed top 120 of the trim plate of the present invention may be positioned at any angle relative to the flange 30.

During the operation of the lighting fixture, the fixture lamp will be housed above the closed top 20, 120 of the trim plate 10. The lamp will generate light which will pass through top 20, 120 as well as sidewall 24. Some of the light will travel down through sidewall 24 to flange 30. The material of construction of the sidewall 24 and flange 30 is such that it will redirect some of the light laterally through the flange 30. The light traveling through the flange 30 will exit and provide an ornamental illumination around the flange and on the area of the wall or ceiling adjacent the lighting fixture. The unitary design of the trim plate 10 will allow for the relamping from below of a lighting fixture recessed in a ceiling simply by slidably removing the trim plate from the fixture.

While the invention has been found in these preferred embodiments in respect to the design of the trim plate and the use thereof, it is apparent that various modifications can be made to the present invention without departing from the spirit or scope of the invention as set forth in the claims appended hereto.

What is claimed is:

1. A luminiferous trim plate for a recessed lighting fixture comprising:

a cup formed of a luminiferous non-conductive material, said cup having an open end and an opposed closed end with a sidewall extending therebetween;

a primary flange extending laterally outward from said cup, an inner periphery of said primary flange defining said open end;

an upward extending lip disposed along the outer periphery of said primary flange;

a secondary flange extending laterally from and circumscribing said cup at said open end, said secondary flange having an outer diameter less than an outer diameter of said primary flange; and, a sealing means disposed on a top surface of said primary flange, said sealing means being disposed between said secondary flange and said lip;

said cup, primary flange, lip and secondary flange being unitarily constructed.

2. The trim plate of claim 1, wherein said cup is frustoconical.

3. The trim plate of claim 1, wherein in said sealing means is a watertight seal.

4. The luminiferous trim plate of claim 1, wherein said sealing means is a gasket.

5. The luminiferous trim plate of claim 1, wherein said non-conductive material is glass.

6. The luminiferous trim plate of claim 1, wherein said non-conductive material is plastic.

7. An assembly for covering a ceiling opening comprising:

a closed top;

a sidewall depending from said closed top, said sidewall having an outer surface and a lower portion; and a primary flange extending laterally outward from said lower portion of said sidewall, said primary flange having an upper surface and an outer periphery;

said closed top, said sidewall and said primary flange being made of a light transmissive material whereby light entering said assembly at said closed top will be partially redirected through said sidewall and said primary flange to provide an ornamental illumination around said primary flange.

8. The assembly of claim 7 wherein said closed top, said sidewall, and said primary flange are unitarily constructed.

9. The assembly of claim 7 further comprising an opaque coating covering said outer surface of said sidewall and said upper surface of said primary flange.

10. The assembly of claim 9 wherein said opaque coating is a material selected from the group consisting of paint, clay, porcelain, and plastic.

11. The assembly of claim 7 further comprising a sealant disposed on said upper surface of said primary flange.

12. The assembly of claim 11 further comprising:

a lip extending upward from and disposed along said outer periphery of said primary flange; and a secondary flange extending laterally outward from said lower portion of said sidewall and disposed above said primary flange;

wherein said sealant is disposed between said lip and said secondary flange.

13. The assembly of claim 11 wherein said sealant is a gasket.

14. The assembly of claim 7 wherein said light transmissive material is selected from the group consisting of plastic and glass.

15. The assembly of claim 7 further comprising:

a mounting ring attached to said sidewall; and a locking member attached to said mounting ring.

16. The assembly of claim 7 wherein said sidewall is frustoconically shaped.

17. A trim assembly for covering the room side edges of a ceiling opening, and for providing a barrier between an area above said ceiling opening and a room area below said ceiling opening, said trim assembly comprising:

a cup having an open end and an opposed closed end with a sidewall extending therebetween, said cup configured to be receivable within said ceiling opening such that said open end is coincident with said ceiling opening and said sidewall and said closed end are located above said ceiling opening;

a primary flange extending laterally outward from said open end of said cup, said primary flange having an upper surface and an outer periphery, said primary flange configured to cover said room side edges of said ceiling opening;

said primary flange and said cup being unitarily constructed of a luminiferous material, whereby light entering said closed end of said cup will be partially redirected through said sidewall and said primary flange to provide an ornamental illumination around said primary flange.

18. The trim assembly of claim 17 wherein said sidewall has an outer surface, said trim assembly further comprising an opaque coating covering said outer surface of said sidewall and said upper surface of said primary flange.

19. The trim assembly of claim 18 wherein said opaque coating is a material selected from the group consisting of paint, clay, porcelain, and plastic.

20. The trim assembly of claim 17 further comprising a sealant disposed on said upper surface of said primary flange.

21. The trim assembly of claim 20 further comprising:

a lip extending upward from and disposed along said outer periphery of said primary flange;

a secondary flange extending laterally outward from said open end of said cup and disposed above said primary flange;

said sealant being disposed between said lip and said secondary flange.

22. The trim assembly of claim 20 wherein said sealant is a gasket.

23. The trim assembly of claim 17 wherein said luminiferous material is selected from the group consisting of plastic and glass.

24. The trim assembly of claim 17 further comprising:

a mounting ring attached to said cup; and a locking member attached to said mounting ring.

25. The trim assembly of claim 17 wherein said cup is frustoconically shaped.

* * * * *